US006682364B2

(12) United States Patent
Cisey

(10) Patent No.: US 6,682,364 B2
(45) Date of Patent: Jan. 27, 2004

(54) CONNECTION DEVICE WITH PUSHER

(75) Inventor: Johann Cisey, Saint Symphorien d'Ancelles (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 10/137,429

(22) Filed: May 3, 2002

(65) Prior Publication Data

US 2002/0187670 A1 Dec. 12, 2002

(30) Foreign Application Priority Data

May 15, 2001 (FR) ..... 01 06406

(51) Int. Cl.[7] ..... H01R 11/20
(52) U.S. Cl. ..... 439/441; 439/835
(58) Field of Search ..... 439/436, 437, 439/438, 441, 834, 835, 836

(56) References Cited

U.S. PATENT DOCUMENTS 4,768,981 A * 9/1988 Hohorst ..... 439/835
6,527,580 B1 * 3/2003 Suss et al. ..... 439/417

FOREIGN PATENT DOCUMENTS

| | | | |
|---|---|---|---|
| CH | 648 958 | A5 | 4/1985 |
| DE | 37 43 409 | A1 * | 6/1989 |
| DE | 37 43 410 | A1 * | 6/1989 |
| EP | 0 303 818 | A2 * | 8/1989 |
| EP | 0 621 483 | A1 | 10/1994 |
| EP | 0 831 557 | A1 | 3/1998 |
| EP | 1 094 551 | A1 | 4/2001 |
| FR | 2 656 164 | A1 | 6/1991 |
| GB | 2 127 627 | A | 4/1984 |

* cited by examiner

*Primary Examiner*—Tho D. Ta
(74) *Attorney, Agent, or Firm*—Olliff & Berridge, PLC

(57) ABSTRACT

This connection device comprises:

an insulating casing comprising at least one opening in order to insert the electrical cable, a connection element which is placed in the insulating casing and which comprises at least one connection spring intended to grip the conducting core of the cable or the plug-in connector, and a pusher associated with the connection element in order to compress the spring and enable the electrical cable or the plug-in connector to be put in place. The pusher has a passage called a test passage, enabling a measuring device to be brought into contact with part of the connection element.

10 Claims, 2 Drawing Sheets

CONNECTION DEVICE WITH PUSHER

BACKGROUND OF THE INVENTION

The invention relates to the technical field of devices used for connecting conductors or connectors to a power and/or data distribution unit.

In a preferred but nonlimiting application, the invention relates to connection devices intended to accommodate one or more electrical cables in order to connect them with electronic devices placed on a printed circuit board.

DESCRIPTION OF THE PRIOR ART

In the above field, it is known to use a connection device for several electrical cables, each comprising a conducting core. The connection device comprises an insulating casing in which several connection chambers are made. The device therefore comprises, in each chamber, a connection element which comprises a connection spring intended to grip the conducting core of an electrical cable which is inserted into the chamber through an insertion opening made in the insulating casing. Furthermore, the connection device comprises, in relation to each connection element, a pusher which acts on the spring in order to compress it and thus allow the electrical cable, which will be gripped by the spring, to be put in place.

Furthermore, each connection element comprises a solderable barb so that a connection can be made to the printed circuit.

Such connection devices are fully satistactory as regards their function of interconnecting a printed circuit with various electrical cables intended to distribute power or to convey information.

However, when using this device and when controlling the operation of the system using the connector, it may appear necessary to carry out measurements in relation to the connected electrical cables. To this end, one solution consists in attaching test devices to the connection barbs plugged into the printed circuit. However, this operation may prove to be tricky when the rear face of the printed circuit is poorly accessible or not accessible at all.

It therefore appears necessary to have available means, preferably in relation to the connection device, to easily measure electrical parameters conveyed by the electrical cables connected to the connection device.

SUMMARY OF THE INVENTION

In order to meet this need, the aim of the invention is a connection device for at least one plug-in connector or an electrical cable comprising a conducting core of the type comprising:

- an insulating casing comprising at least one opening in order to insert the electrical cable,
- a connection element which is placed in the insulating casing and which comprises at least one connection spring intended to grip the conducting core of the cable or the plug-in connector,
- and a pusher associated with the connection element in order to compress the spring and enable the electrical cable or the plug-in connector to be put in place.

According to the invention, the connection device is characterized in that the pusher has a passage called a test passage, enabling a measuring device to be brought into contact with part of the connection element.

The connection spring may either form an integral part of the connection element, or be attached thereto. Thus, the spring may consist of a curved strip of the connection element which presses the conductor against a fixed part of this same connection element. The spring may also consist of a spring in a loop, as described, for example, in application FR-2 773 914.

According to a characteristic of the invention, in order to offer a contact having good electrical conductivity qualities, the connection element has a fixed part placed in relation to the test passage of the pusher in order to offer a contact surface for a measuring device inserted through the test passage.

According to another characteristic of the invention, the test passage of the pusher is positioned in relation to the connection spring and enables a measuring device to be brought directly into contact with the connection spring.

According to yet another characteristic of the invention, the pusher has means of connecting with the spring in order to follow the movements thereof. This advantageous arrangement of the invention makes it possible to reduce as much as possible the clearance which could exist between the pusher and the connection spring, a clearance which could lead to measurement errors when putting a device in place in the test passage of the pusher.

According to a characteristic of the invention, the connection means comprise a lug intended to be engaged behind a part of the spring, away from a bearing face of the pusher on the spring.

According to another characteristic of the invention, the pusher can be moved between an inserted position and a raised position and has a recess intended to be aligned, in the inserted position, with the opening for inserting the insulating casing.

According to another characteristic, in order to prevent movements of the pusher which are too large, the latter has a drive head which has a collar limiting the insertion of the pusher into the insulating casing.

According to another characteristic of the invention, the pusher has stop means preventing it being removed from the insulating casing.

According to yet another characteristic of the invention, when the connection device is intended to be mounted onto a printed circuit board, each connection element has, preferably but not necessarily, a barb connecting the device to a printed circuit or similar. This barb may, for example, be intended to be soldered or immobilized by being clamped into a receiving orifice made, for example, in the printed circuit.

According to yet another characteristic of the invention, the connection device is intended to allow the connection of at least two, or even more, electrical cables. To this end, the insulating casing of the device comprises at least two connection chambers, each associated with an opening for inserting a cable. Furthermore, the device comprises a connection element associated with an independent pusher, in each connection chamber.

BRIEF DESCRIPTION OF THE DRAWINGS

Various other characteristics of the invention will become apparent from the description below, made with reference to the appended drawings which show a nonlimiting embodiment of a connection device according to the invention.

DESCRIPTION OF THE PREFERRED EMBODIMENTS

Figure 2:
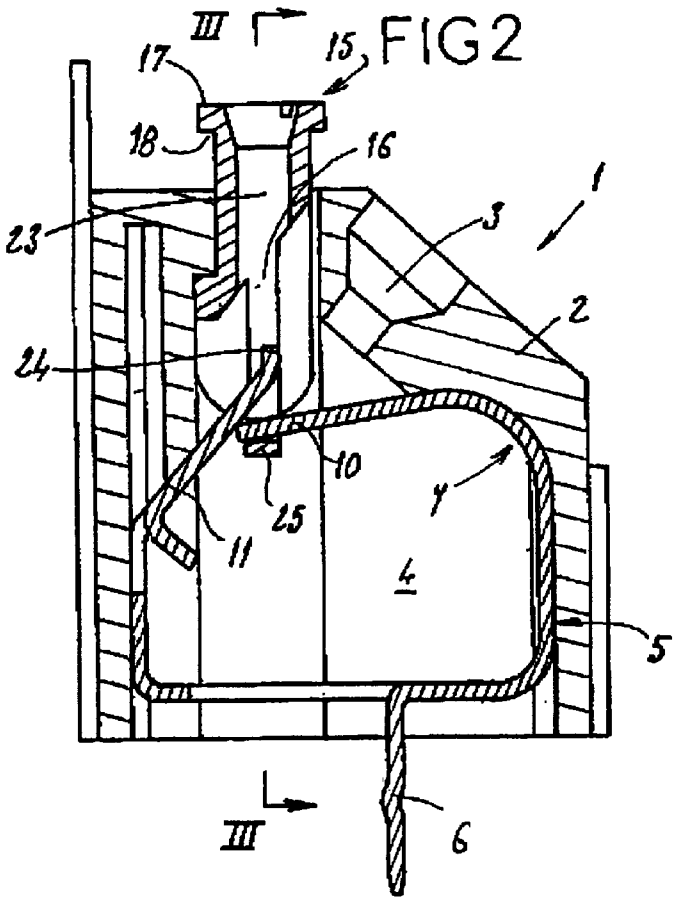
FIG. 2 is a cross section through the plane II—II of FIG. 1.
Figure 1:
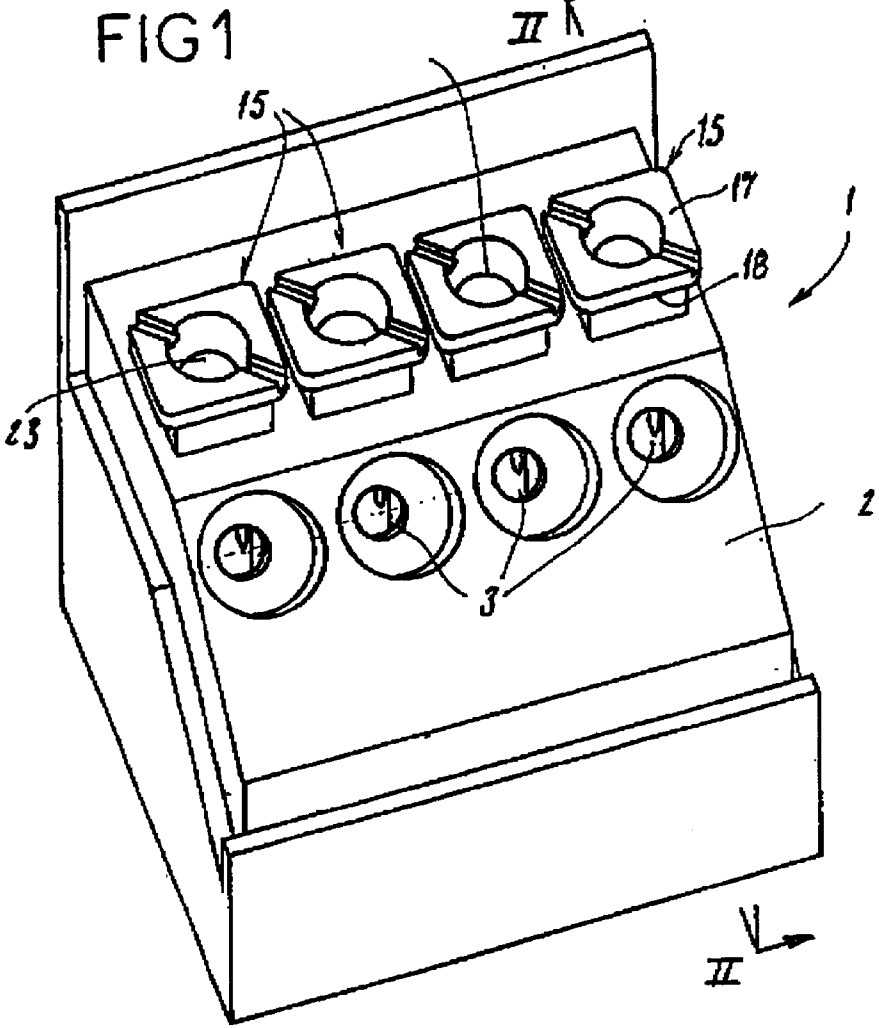
FIG. 1 is a perspective view illustrating an embodiment of a connection device according to the invention.
Figure 3:
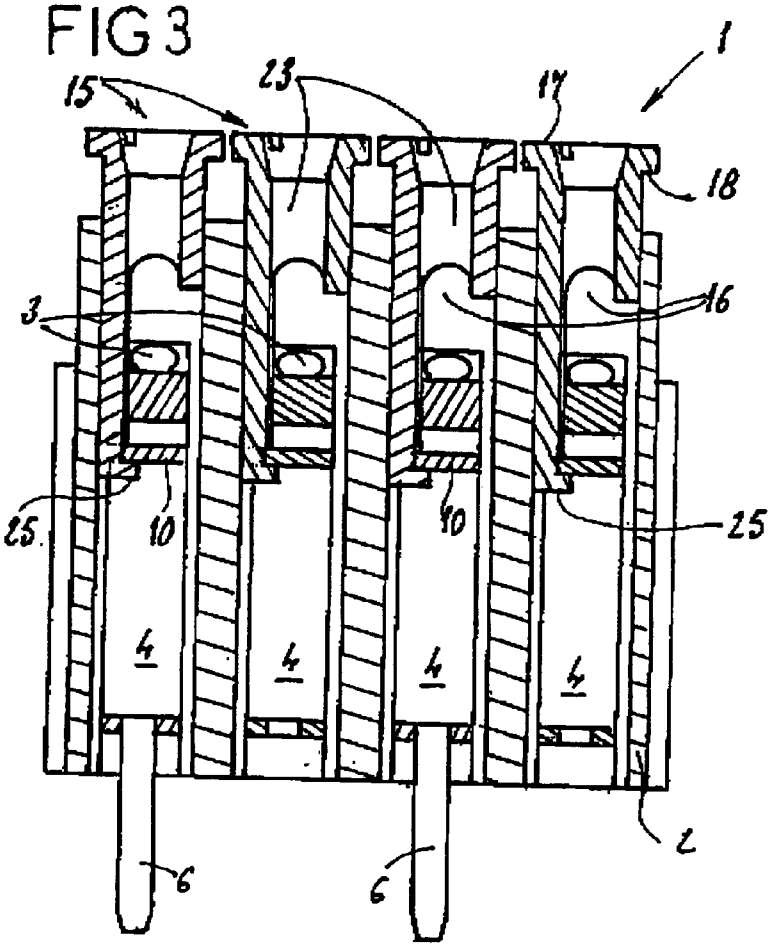
FIG. 3 is a longitudinal section through the plane III—III of FIG. 2 of the connection device according to the invention.

As is shown in FIGS. 1 to 3, a connection device according to the invention and denoted overall by the reference 1, comprises a casing 2 made of an insulating material, such as for example a plastic. The device 1, according to the example illustrated, is intended to allow four electrical cables (not shown) to be connected. To this end, the casing 2 comprises four openings 3, each of which opens into a connection chamber 4 and which thus enables an electrical cable to be inserted into this chamber.

In each connection chamber 4, the connection device 1 comprises a connection element 5 intended to provide the electrical connection between the conducting core of an electrical cable and the electrical plant using the connection device according to the invention. According to the example illustrated, the connection device 1 is intended to be fitted onto a printed circuit board, each connection element 5 then comprises a barb 6 intended to be engaged in a complementary hole in the printed circuit in order to be possibly soldered thereto.

Figure 4:
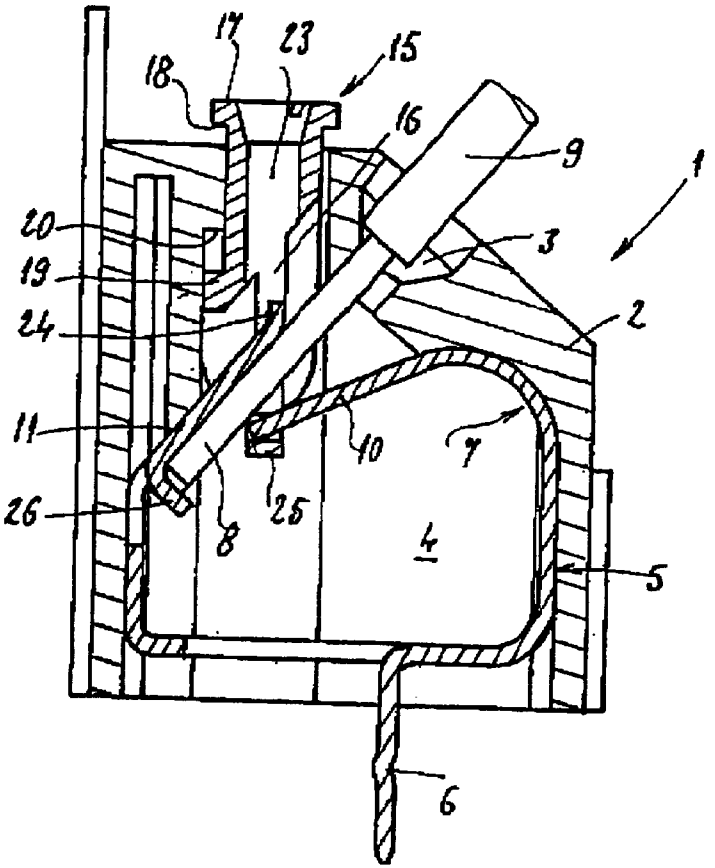
FIG. 4 is a view similar to FIG. 2, showing a phase of using the device according to the invention.

Moreover, the connection element 5 comprises a connection spring 7, placed in relation to the corresponding insertion opening 3 and intended to grip the conducting core 8 of an electrical cable 9 inserted through the opening 3, as is illustrated in FIG. 4. According to the example illustrated, the connection spring 7 consists of a curved part of the connection element 5 which defines an elastic strip 10. Moreover, the connection element 5 comprises a heel 11 against which the strip 10 presses the conducting core 8 of the cable 9.

To facilitate putting the electrical cable in place, the device 1 comprises, in relation to each connection spring 7, a pusher 15 made of an insulating material. The pusher 15 can be moved between a raised position, as illustrated in FIG. 2, and an inserted position (not shown) in which it bears on the strip 10 in order to compress it so as to separate it from the heel 11 and thus facilitate putting the conducting core of the electrical cable in place between the strip 10 and the heel 11.

In order to allow this placement, the pusher 15 comprises a housing 16 intended to be aligned with the insertion opening 3 in the inserted position of the pusher 15. It should be noted that, in a preferred but not strictly necessary manner, in order to limit the insertion of the pusher 15 into the casing 2, the pusher comprises a drive head 17 which has a collar 18 bearing against the casing when the pusher 15 is inserted. Similarly, the pusher 15 has a stop 19 intended to bear against a complementary end stop 20 of the casing 2. The two stops 19 and 20 thus prevent the pusher 15 coming out of the casing 2.

According to an essential feature of the invention, each pusher 15 has a passage 23 called a test passage enabling a measuring device (not shown) to be brought into contact with part of the connection element 5. According to the example illustrated, the test passage 23 consists of a central through-bore made in the pusher 15 opening out on a curved fixed part 24 of the heel 11 of the connection element 5. Thus, the passage 23 allows a test plug to be inserted in order to be put in contact with the fixed part 24, such that it is possible to carry out measurements in relation to the electrical cable connected to the connection element 5.

According to a preferred but not strictly necessary embodiment of the invention, the pusher 15 has means of connecting with the connection spring 7. According to the example illustrated, these connection means 25 consist of a lug intended to bear on the rear face of the strip 10 away from a bearing face of the strip 10 on the pusher 15. The presence of this lug 25 then makes it possible for the pusher 15 to follow the movements of the strip 10 so as to keep the pusher 15 as close as possible to the fixed part 24 intended to offer electrical contact for a test device. This advantageous arrangement of the invention thus prevents measurement errors which could occur following poor insertion of a test plug into the passage 23 of the pusher 15.

Moreover, it should be noted that, in the preferred embodiment illustrated, each connection element 5 has a tab 26 called a confinement tab intended to prevent direct contact between the casing 2 and the core 8 of the cable 9 when putting the latter in place.

In the above description, the connection of an electrical cable to each connection element 5 was reported. However, according to the invention, the connection of an electrical plug directly to the connection element 5 at the spring 7 could be envisioned. Similarly, the device described involved four connection chambers associated with four connection elements 5. However, a connection device according to the invention could comprise more than four connection chambers or, in contrast, less and especially a single connection chamber.

Similarly, the embodiment described of the connection device according to the invention relates to a device intended to be fitted onto a printed circuit. However, the connection device according to the invention could form an interconnect box or else a plug-in connector, in which case the barb 6 of each connection element 5 would be replaced by a connection system of the male or female type intended to cooperate with a complementary device such as, for example, a terminal block or an interconnect box.

The invention is not limited to the examples described above and may be provided with various modifications without departing from the scope thereof.

What is claimed is:

1. A connection device for at least one electrical cable comprising a conducting core or for a plug-in connector, of the type comprising:

an insulating casing comprising at least one opening in order to insert the electrical cable, a connection element which is placed in the insulating casing and which comprises at least one connection spring intended to grip the conducting core of the cable or the plug-in connector, and a pusher associated with the connection element in order to compress the spring and enable the electrical cable or the plug-in connector to be put in place, wherein the pusher has a passage, called a test passage, integrally formed in the pusher and located only through the pusher, enabling a measuring device to be brought into contact with part of the connection element.

2. The connection device as claimed in claim 1, wherein the test passage of the pusher is positioned in relation to the connection spring and enables the measuring device to be brought into contact with the connection spring.

3. The connection device as claimed in claim 1, wherein the pusher can be moved between the inserted position and a raised position and further wherein the pusher has a housing intended to be aligned, in the inserted position, with the opening of the insulating casing for inserting the electric cable.

4. The connection device as claimed in claim 1, wherein the connection element has a fixed part placed in relation to the test passage of the pusher in order to offer a contact surface for a measuring device inserted through the test passage.

5. The connection device as claimed in claim 1, wherein the pusher has a drive head which has a collar limiting the insertion of the pusher into the insulating casing.

6. The connection device as claimed in claim 1, wherein the connection element comprises at least one barb for connecting the device to a printed circuit or similar.

7. The connection device as claimed in claim 1, wherein:

the casing comprises at least two connection chambers, each associated with an insertion opening, each chamber contains a connection element associated with a pusher.

8. The connection device as claimed in claim 1, wherein the connection spring consists of a curved part of the connection element.

9. The connection device as claimed in claim 1, wherein the pusher has means of connecting with the spring in order to follow the movements thereof.

10. The connection device as claimed in claim 9, wherein the connection means comprise a lug intended to be engaged with a part of the spring, away from a bearing face of the pusher on the spring.

* * * * *